US007347759B2

(12) United States Patent
Williams, Sr. et al.

(10) Patent No.: US 7,347,759 B2
(45) Date of Patent: Mar. 25, 2008

(54) SELF-PROPELLED TOY DUCK

(76) Inventors: Robert Brian Williams, Sr., 661 Favorwood Dr., Marietta, GA (US) 30060; Susan Shipley Adkison, 1495 Bentcreek Dr., Marietta, GA (US) 30062

( * ) Notice: Subject to any disclaimer, the term of this patent is extended or adjusted under 35 U.S.C. 154(b) by 325 days.

(21) Appl. No.: 11/210,776

(22) Filed: Aug. 24, 2005

(65) Prior Publication Data

US 2007/0054591 A1 Mar. 8, 2007

(51) Int. Cl.
*A63H 23/10* (2006.01)

(52) U.S. Cl. ..... 446/157; 446/158; 43/26.2

(58) Field of Classification Search ..... 446/153, 446/154, 155, 156, 158; 43/26.2, 26.1
See application file for complete search history.

(56) References Cited

U.S. PATENT DOCUMENTS 1,828,034 A * 10/1931 Einfalt ..... 446/158
2,704,416 A * 3/1955 Laird ..... 446/158
3,601,922 A 8/1971 Shaffer
3,628,286 A 12/1971 Mashahiro
3,808,734 A * 5/1974 Suzuki ..... 446/158
4,068,401 A 1/1978 Saitoh
4,778,429 A * 10/1988 Todokoro ..... 446/153
4,832,650 A 5/1989 Tong
5,197,913 A * 3/1993 Suzuki ..... 446/156
5,344,357 A 9/1994 Lyczek
6,553,709 B1 * 4/2003 Owen ..... 43/3
6,631,581 B2 * 10/2003 Gomes et al. ..... 43/26.2

* cited by examiner

*Primary Examiner*—Kien Nguyen
(74) *Attorney, Agent, or Firm*—Clements Bernard Miller; Lawrence A. Baratta, Jr.; Christopher L. Bernard

(57) ABSTRACT

A self-propelled aquatic apparatus having a duck shaped body, wherein the body is partially filled with floatation material, a base, a waterproof battery container, a battery, a battery compartment, an electro-mechanical propulsion mechanism having a pair of webbed feet, which alternately articulate from a forward down position to a rearward raised position, and a power switch. The webbed feet are slightly cupped to enhance paddling efficiency when moving from the forward down position to the rearward raised position, and are made of a relatively flexible material, such that the webbed feet will distort rather than break if they encounter a hard surface or are bent, and will not scratch the skin. The webbed feet have a coupling extension, where said coupling extension has an end that is longer in the front and shorter in the back, where the shorter end enables each of the webbed feet, while in the rearward raised position, to rotate closer to the body as the apparatus is propelled through water, thereby lowering the hydrodynamic resistance of the raised webbed foot.

17 Claims, 8 Drawing Sheets

SELF-PROPELLED TOY DUCK

BACKGROUND OF THE INVENTION

1. Field of the Invention

The invention relates to self-propelled apparatus, and more particularly to aquatic toys having an electro-mechanical articulating propulsion mechanism.

2. Prior Art

U.S. Pat. No. 4,832,650 to Duncan Tong describes one form of self-propelled aquatic toy. The toy has a body portion and at the rear a middle tail and an outer tail. The middle tail is pivoted by suitable drive means so that it reciprocates from side to side and the outer tail is freely pivoted to the middle tail. As a result, such a toy is driven through the water by the side-to-side reciprocation of the middle tail and some power in driving the creature is obtained as the outer tail flaps from side to side.

What is desired is an aquatic toy having an electro-mechanical articulating propulsion mechanism, wherein said mechanism simulates the action of a duck, and other similar waterfowl.

SUMMARY OF THE INVENTION

The present invention is a self-propelled aquatic apparatus having a body that is partially filled with floatation material, a base, a waterproof battery container, a battery, a battery compartment, an electro-mechanical propulsion mechanism, wherein the mechanism comprises at least one articulating propulsion member, an electric power control switch that is in selectable control of the electrical conduction between the waterproof battery container and the electro-mechanical propulsion mechanism. An example of a body is a duck, and an example at least one articulating propulsion member is a pair of webbed feet, which alternately articulate from a forward down position to a rearward raised position. An example of an electric power control switch is an on-off power switch or a rheostat for variable speed control.

BRIEF DESCRIPTION OF THE DRAWINGS

The foregoing and other objects will become more readily apparent by referring to the following detailed description and the appended drawings in which.

DETAILED DESCRIPTION

Figure 1:
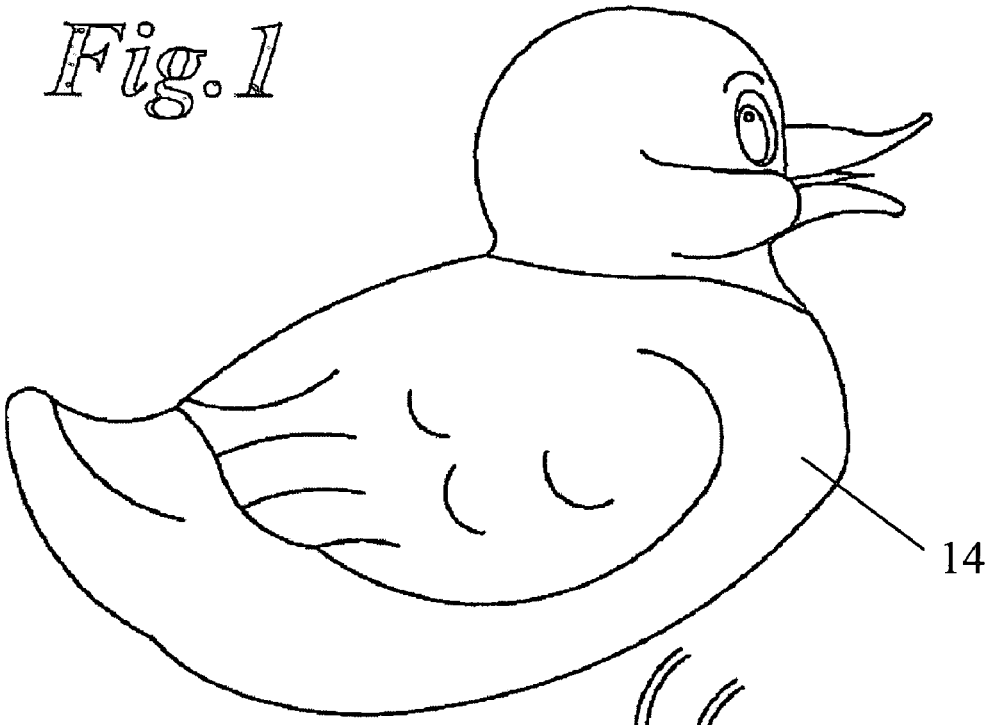
FIG. 1 is a perspective view of the upper body of a self-propelled aquatic apparatus, wherein the apparatus is a toy duck.

The invention is a self-propelled aquatic apparatus 10 having a body 12 that is partially filled with floatation material 18, a base, a waterproof battery container 22, a battery 20, a battery compartment 50, an electro-mechanical propulsion mechanism 26, wherein the mechanism comprises at least one articulating propulsion member 28, an electric power control switch 130 that is in selectable control of the electrical conduction between the waterproof battery container and the electro-mechanical propulsion mechanism.

Figure 7:
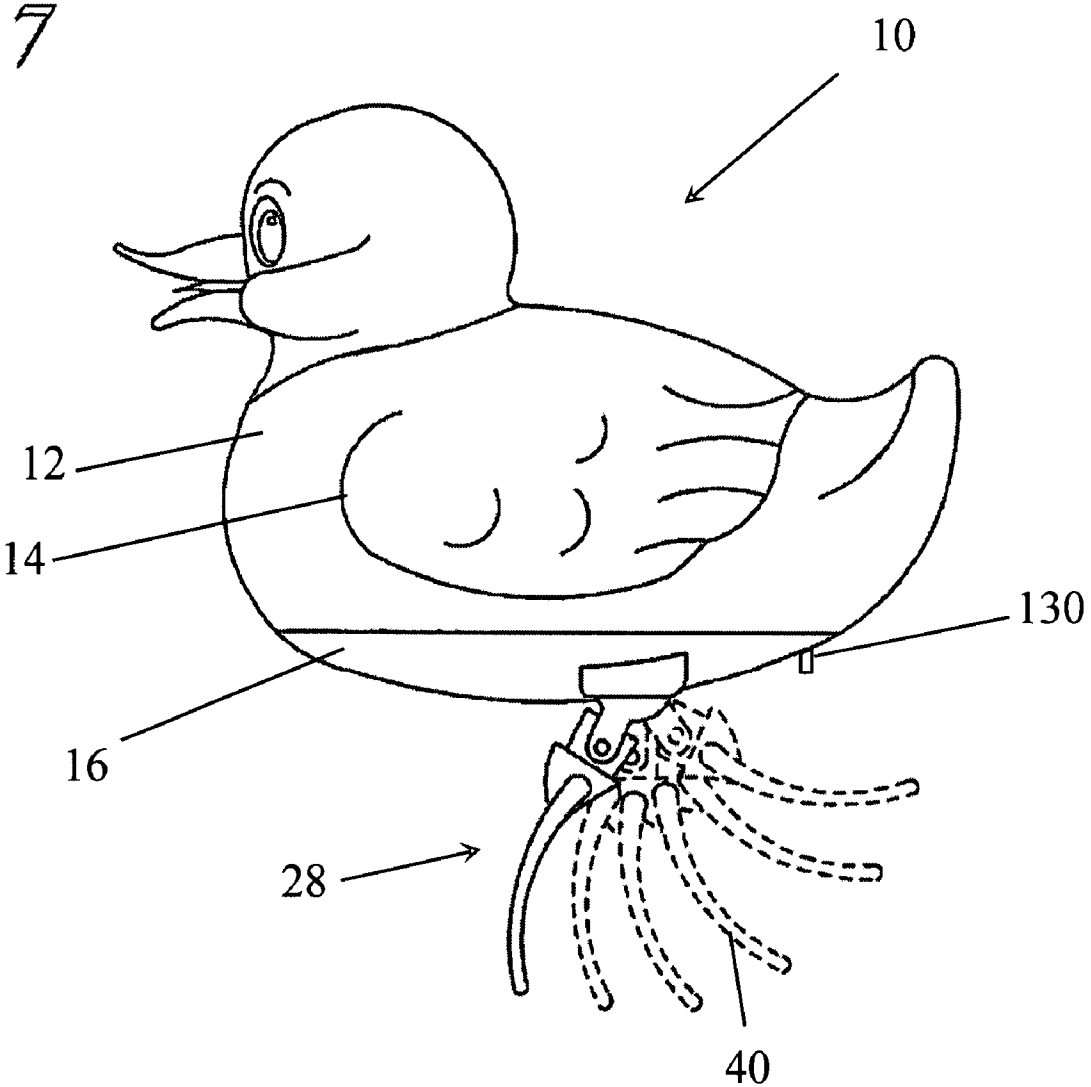
FIG. 7 is a side view of the self-propelled toy duck illustrating the relative position of the webbed feet.

The illustrated embodiment has a body of a toy duck, wherein the articulating propulsion members 28 is a pair of webbed feet 40, which alternately articulate from a forward down position to a rearward raised position. In the illustrated example the electric power control switch is an on-off power switch 130, which is located on near the rear of the duck. The self-propelled toy duck is illustrated in FIG. 7. The duck 10 has a body 12 that is comprised of an upper body 14 and a lower body 16. Projecting from the lower body are the articulating members 28, a pair of webbed feet 40.

Figure 10:
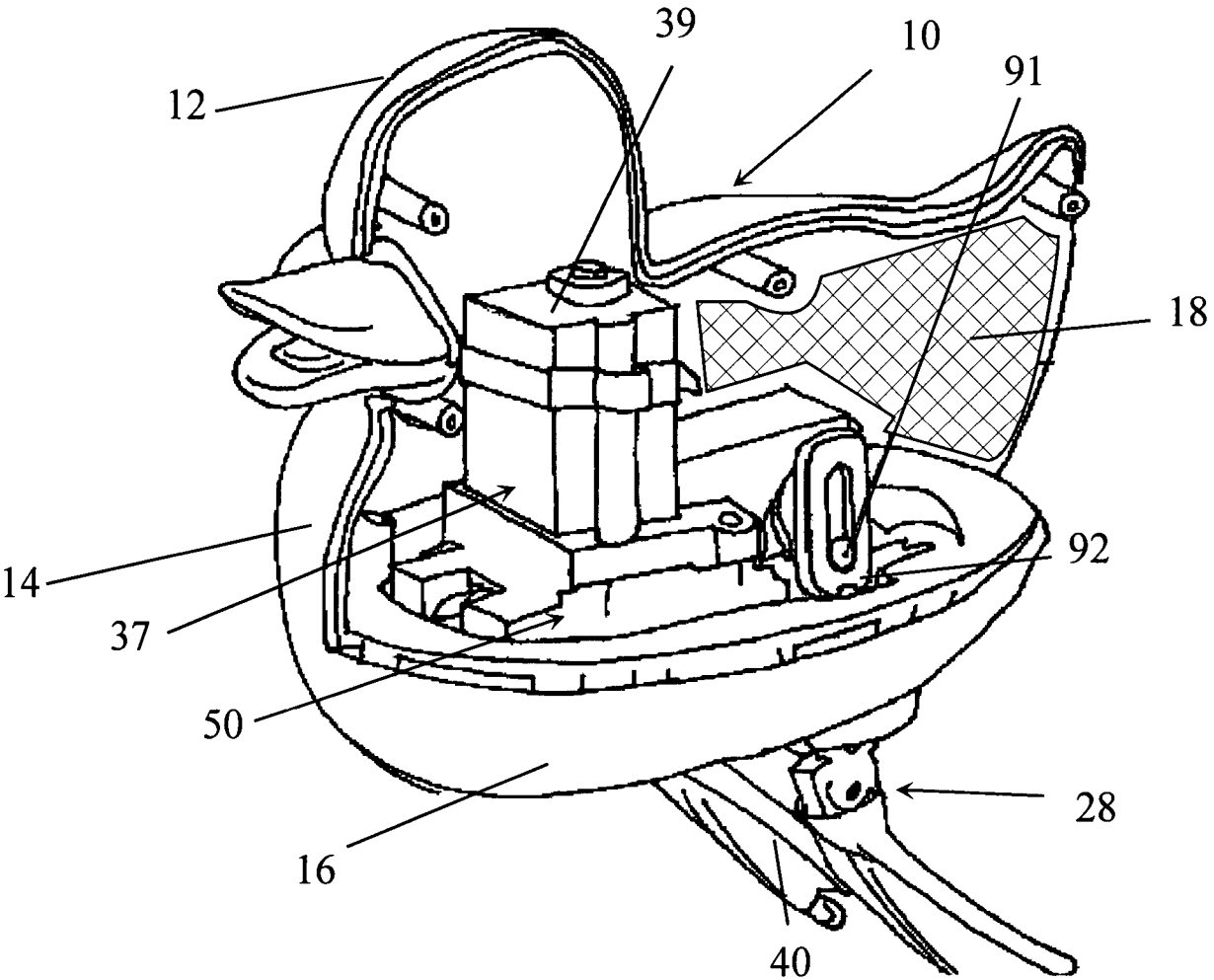
FIG. 10 is a partially cut-away view of the toy duck illustrating the relative position of the flotation material, the housing for the electromechanical propulsion mechanism, and the compartment for the battery container and battery contained therein.

FIG. 10 is a partially cut-away view of the duck illustrating many of the major components. Much of the upper interior portion of the duck is filled with flotation material 18, such as Styrofoam, while the remainder of the interior portion is substantially occupied by the electromechanical propulsion mechanism and the housings protecting them.

Figure 2:
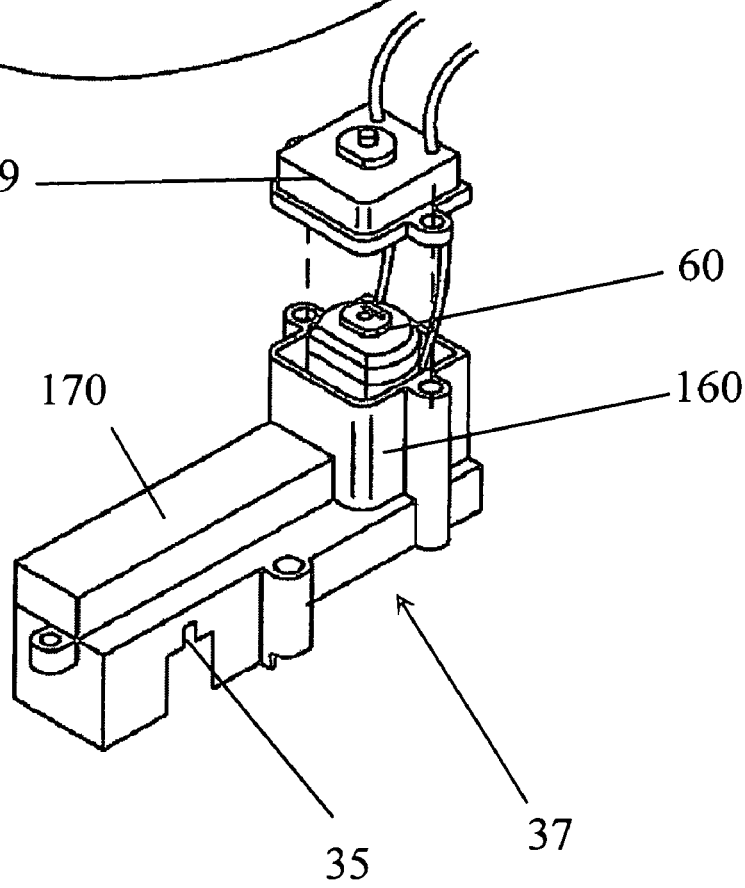
FIG. 2 is a perspective view of a housing having two chambers, a waterproof chamber for housing the motor, and a gear chamber for supporting and protecting the gear assembly.
Figure 3:
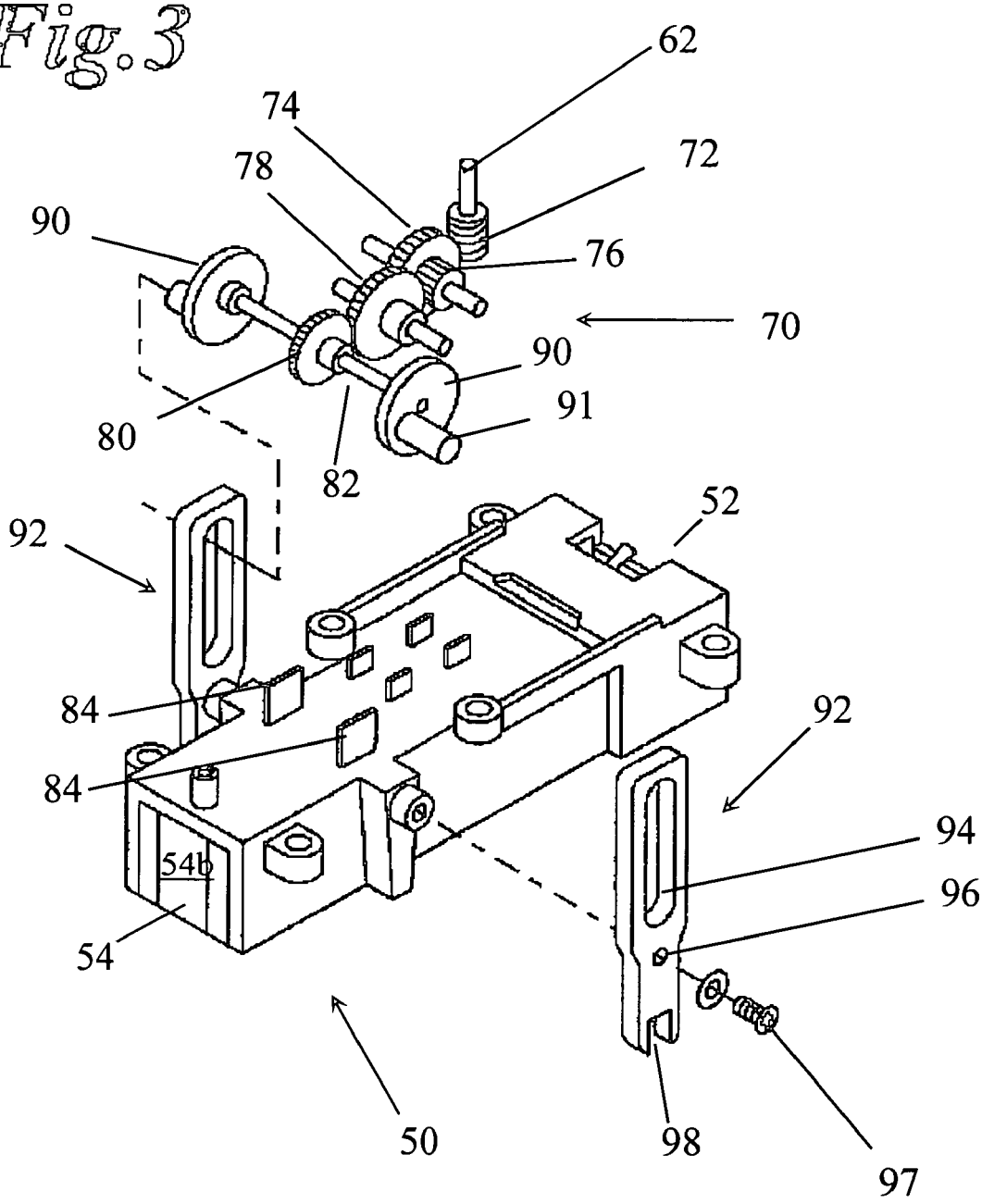
FIG. 3 is an exploded view of the gear assembly; a pair of cranks, wherein each is drives a primary rocker, and a compartment for receiving a waterproof battery container.

Referring to FIG. 2, housing 37 is comprised of a waterproof chamber 160 and a gear assembly chamber 170. The waterproof chamber secures the electric motor 60 and seals the chamber with cap 39. The gear assembly chamber 170 protects the worm and reducing gears and provides a journal/groove 35 with a live axle 32 of the gear assembly 70. The gear assembly is illustrated in FIG. 3. Housing 37 is attached to a compartment 50, which as shown in FIG. 3 has chamber 170 that provides for the gear assembly. The gear assembly 70 is comprised of worm 72 on electric motor shaft 62, where the worm 72 drives worm gear 74. Worm gear 74 has an adjacent reducing gear 76, which drives idler gear 78, which in turn drives a drive gear 80. Drive gear 80 turns a live axle 82, which is fitted with a pair of cranks; a left crank and a right crank 90. The cranks are positioned such that the pawl 91 of one crank is 180 degrees out of phase with the pawl on the opposing crank. One crank rotates clockwise, while the other crank rotes counterclockwise. The live axle is positioned so that it rests on supports 84 and is aligned by the groove/journal 35 of the housing 37 (see FIG. 2). A given crank 90 causes the connected primary rocker 92 to oscillate forward, while the opposing crank causes the connected primary rocker 92 to oscillate backwards. The action can best be seen in FIG. 5 and FIG. 6.

Figure 6:
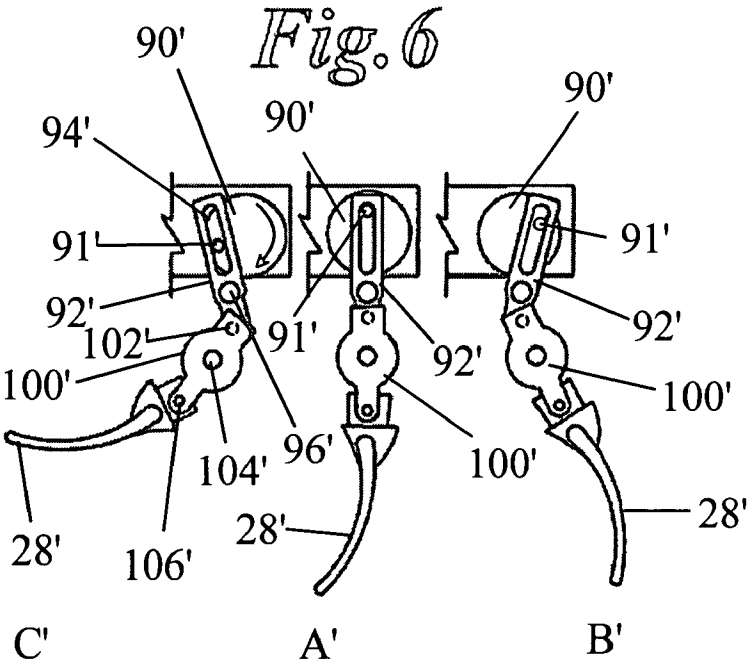
FIG. 6 illustrates the opposing side of the toy duck wherein the crank is turning clockwise, and the pawlls of the cranks are offset from each other by 180 degrees, such that when one webbed foot is paddling backwards driving the duck forward, the other webbed foot is moving forward.
Figure 5:
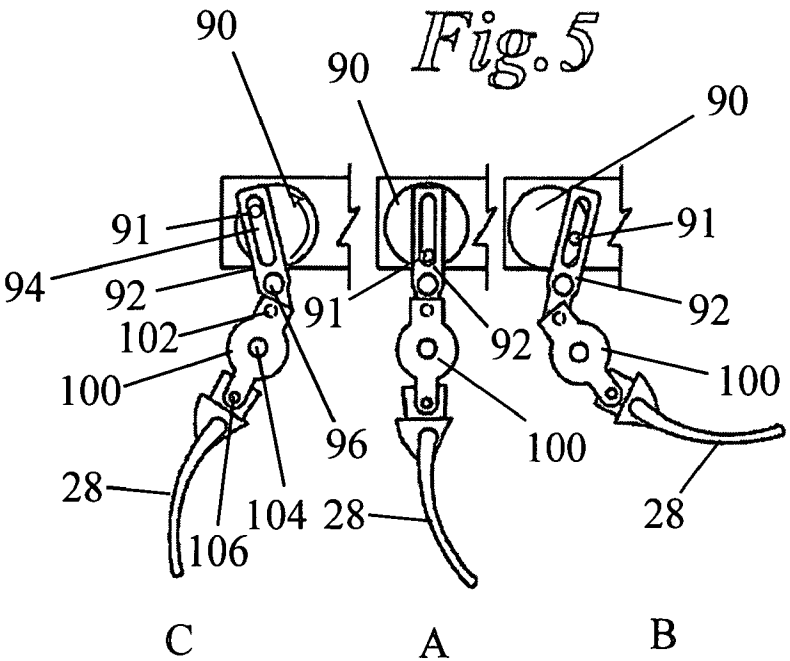
FIG. 5 is a diagrammatic side view illustrating how the crank interacts with the primary rocker, the secondary rocker, and the articulating member to produce articulation. The crank is turning counterclockwise.

To differentiate a right side from a left side, the right side indices have been designated with an apostrophe. As shown in FIG. 5 from left to right, the left crank 90 turning counterclockwise causes the pawl 91, moving in slot 94 of the primary rocker 92, to move the primary rocker 92 to the left. Primary rocker 92 is fixedly pivoted at point 96 by a screw 97 (see FIG. 3), therefore causing the stirrup 98 to move to the right. The secondary rocker 100 is fixedly pivoted at 104 and has an upper axle 102, which intersects with the stirrup 98. The leftward movement of primary rocker 92 causes a rightward movement of the secondary rocker 100, and this causes the articulating element 28, which is connected to the secondary rocker at the lower axle 106 to move forward. The articulating element moves backwards when the pawl is in the down position as shown in B. Note, the primary rocker is in the center and therefore so is the secondary rocker, when the pawl is at 12 or 6 o'clock position. As the pawl starts moving up, as shown in 5C, pressure is applied to the right side of slot 94 causing the primary rocker 92 to move to the right. In turn, the secondary rocker 100 moves to the left and the articulating element 28 is brought up toward the rear closer to the lower body. The reciprocal action occurs in FIG. 6. As the crank turns clockwise, the primary rocker moves to the right and the secondary rocker moves to the left. In comparing FIG. 5 and FIG. 6, the reader is reminded that crank in FIG. 5 as illustrated is turning counterclockwise, while the crank in FIG. 6 is turning clockwise, however propulsion is not dependent on the direction of rotation of the cranks, however the rotation is synchronized such that as depicted the duck moves forward. It is recognized that in some embodiments of the invention, frontward and rearward motion would be desirable and this can be achieved by changing the rotation of the live axle.

Figure 4:
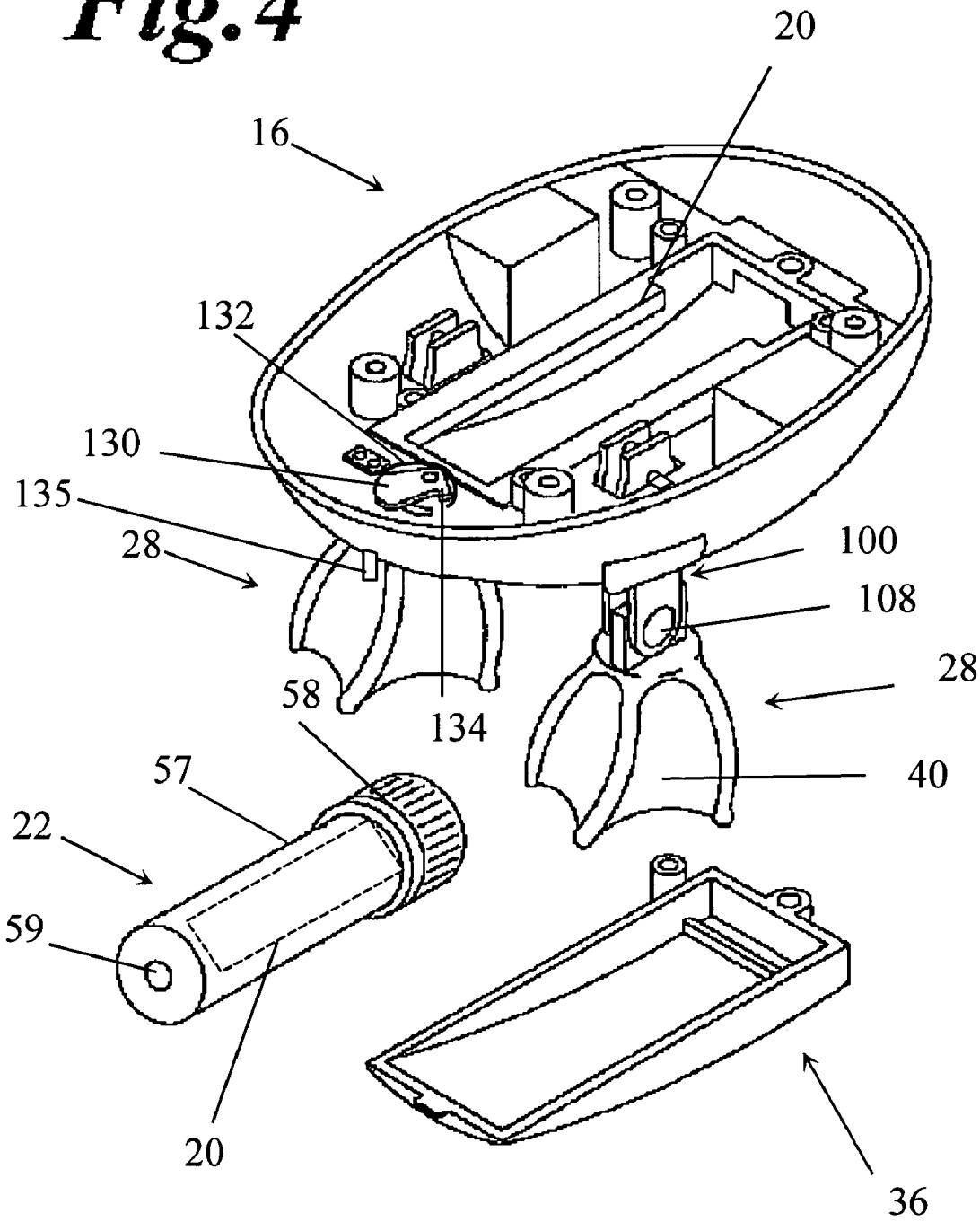
FIG. 4 is a perspective view of the lower body of the self-propelled aquatic apparatus, where the apparatus is a toy duck, a waterproof battery container, and a cover. The view also illustrates the switch and the articulating members, which are webbed feet.

Now referring again to FIG. 3, the compartment 50 has a positive contact 52 and a negative contact 54 wherein the contacts are 2-sided and provide an electrical conduit for electrical energy emanating from a battery container 22 shown in FIG. 4. 4B is the outside electrical contact 54B is a U-shaped band of metal wrapped around the end wall of the compartment 50. The opposing end of the compartment 50 as the positive contact 52, which has a similar u-shaped wire, all by the wire on the inside is spring-loaded. The compartment is attached to the face 20 of the lower body, as shown in FIG. 4.

The elements of the switch 130 are illustrated in FIG. 4. The switch 130 has an external lever 135, which controls the position of the cam arm 134. The cam arm 134 is in contact with a flat spring contact wire 132 that is pushed into contact with the outside electrical contact 54B of the compartment 50 when the external lever 135 is slide to one side, thereby actuating the electro-mechanical propulsion mechanism 26. The waterproof battery container 22 is comprised of a twist off cap 58 with a seal (not shown) and a cylinder 57 having a bottom with a spring and a mouth. The cap has an electrical contact that extends through the cap, and the spring has an electrical contact that extends through the bottom, which has a through-bottom contact 59. When the waterproof battery container 22 is in the compartment 50, the battery 20, shown in ghost, is electrical communication with the compartment contacts 54 and 52.

Figure 8:
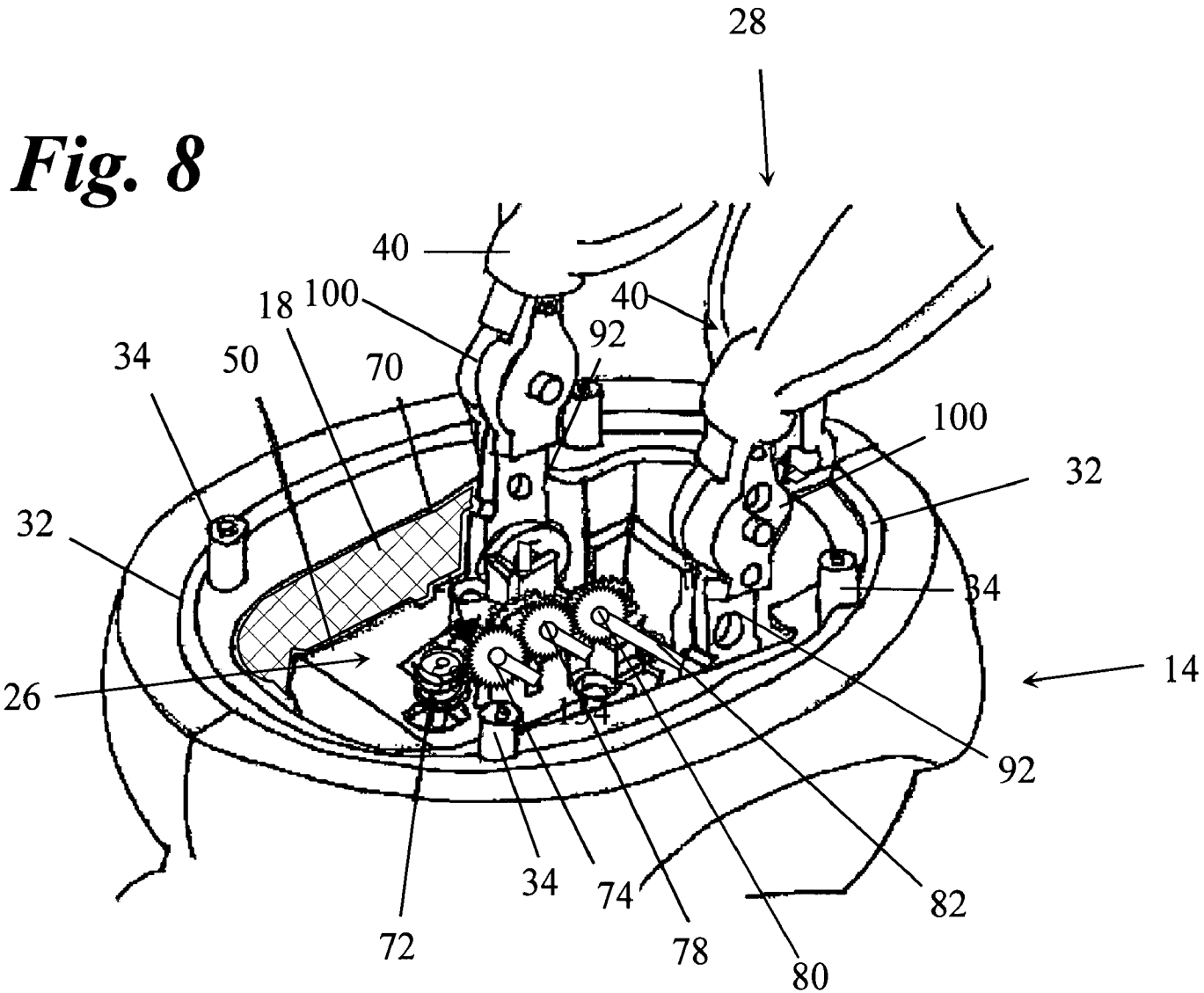
FIG. 8 is an overhead view of the bottom of the upper body, wherein the lower body has been removed.

FIG. 8 is an overhead view of the bottom of the upper body, wherein the lower body has been removed. The upper body 14 is fitted with a sealing ring 32 with aligning tapped studs 34 for connecting the upper and lower body. Most of the electro-mechanical propulsion mechanism 26 is visible as the housing 37 is removed. The motor and waterproof chamber 160 are projecting upward into the neck region of the duck.

Figure 9:
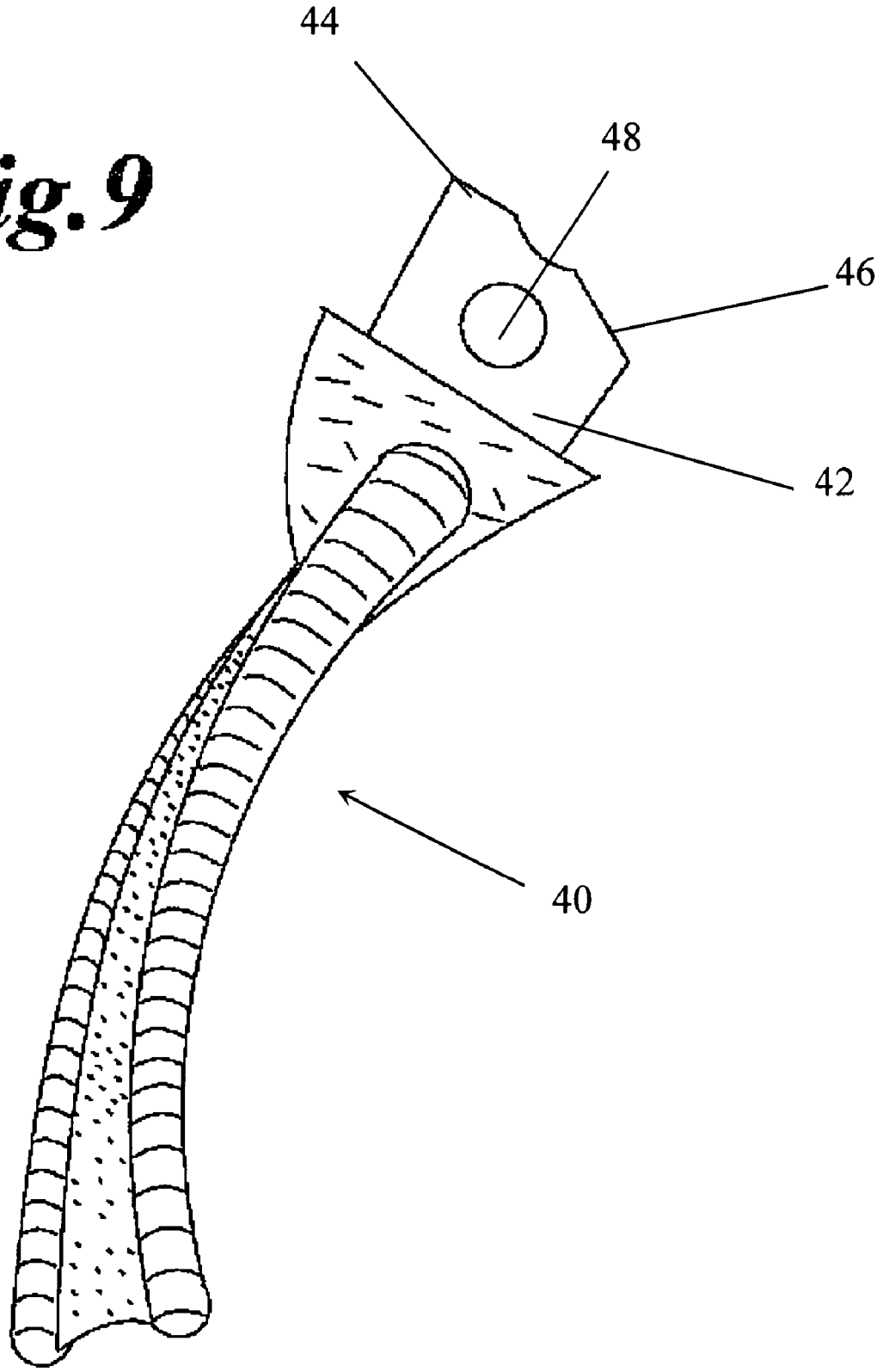
FIG. 9 is an enlarged side perspective view of a webbed foot having a coupling extension, wherein the foot is slightly cupped and the extension has a shorter end that allows the foot to shift closer to the lower body, thereby reducing hydrodynamic drag on the toy duck.

FIG. 9 is an enlarged side perspective view of a webbed foot 40 having a coupling extension 42. The foot is slightly cupped to facilitate paddling. The extension 42 has a shorter end 46 that enables each of the webbed feet, while in the rearward raised position, to rotate closer to the lower body as the apparatus is propelled through water, thereby lowering the hydrodynamic resistance of the raised webbed foot. The longer end 44 acts as a stop to prevent the webbed foot from bending as the foot is articulating (paddling) from the front to the rear. The hole 48 enables each foot to be connected to the lower axle 106 of the corresponding secondary rocker 100. The webbed feet are comprised of a relatively flexible material, like plasticized PVC or rubber, such that the webbed feet will distort rather than break if they encounter a hard surface or are bent. The feet are soft enough and have no sharp edges such that will scratch the skin of a small child.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is, therefore, understood to be limited only by the scope of the appended claims.

What is claimed is:

1. A self-propelled aquatic apparatus, said apparatus comprising:

a body, wherein said body is partially filled with floatation material, wherein said body comprises an upper body and a lower body that are joined by a sealing ring with aligning tapped studs, and wherein the lower body has an external form that provides relatively low hydrodynamic resistance;

a base;

a waterproof battery container;

a battery;

an electro-mechanical propulsion mechanism, wherein said mechanism comprises at least one articulating propulsion member; and an electric power control switch that is in selectable control of the electrical conduction between the waterproof battery container and the electro-mechanical propulsion mechanism.

2. The apparatus, as claimed in claim 1, wherein said body has the shape of waterfowl.

3. The apparatus, as claimed in claim 2, wherein said at least one articulating propulsion member are a pair of webbed feet, which alternately articulate from a forward down position to a rearward raised position.

4. The apparatus, as claimed in claim 3, wherein the webbed feet are slightly cupped to enhance paddling efficiency when moving from the forward down position to the rearward raised position.

5. The apparatus, as claimed in claim 4, wherein the webbed feet are comprised of a relatively flexible material, such that the webbed feet will distort rather than break if they encounter a hard surface or are bent.

6. The apparatus, as claimed in claim 5, wherein each of the webbed feet have a coupling extension, where said coupling extension has an end that is longer in the front and shorter in the back, where the shorter end enables each of the webbed feet, while in the rearward raised position, to rotate closer to the lower body as the apparatus is propelled through water, thereby lowering the hydrodynamic resistance of the raised webbed foot.

7. The apparatus, as claimed in claim 1, wherein said base has a compartment with a spring loaded positive electrical two-sided contact and a negative electrical two-sided contact for receiving and electrically contacting the water proof battery container.

8. The apparatus, as claimed in claim 7, wherein said lower body has a cover that enables access to the compartment.

9. The apparatus, as claimed in claim 8, wherein said electro-mechanical propulsion mechanism is further comprised of an electric motor having a shaft, a gear assembly, and a pair of cranks, where each crank actuates a primary rocker that actuates a secondary rocker, that articulates one of the pair of webbed feet.

10. The apparatus, as claimed in claim 9, wherein said gear assembly is comprised of a worm, a worm gear having an adjacent reduction gear, an idler gear and a drive gear on a live axle, where the live axle rests on a pair of supports on the base.

11. The apparatus, as claimed in claim 10, wherein the live axle is terminated with a pair of cranks that are 180 out-of-phase, such that when one crank is moving the primary rocker forward, the opposing crank is moving the opposing primary rocker backward, and vice versa.

12. The apparatus, as claimed in claim 11, wherein each primary rocker is an elongate element having an elongate slot that receives a pawl on the crank, a fixed pivot point wherein a bearing that is threadedly attached to a side of the base, and a distal stirrup that engages the secondary rocker.

13. The apparatus, as claimed in claim 12, wherein each secondary rocker has an upper axle that is engaged by the distal stirrup on the primary rocker, a center axle that rests on journals molded into the lower body, and a lower axle that is connected to the coupling extension of the webbed foot.

14. The apparatus, as claimed in claim 11, wherein said apparatus is further comprised of a housing having a waterproof chamber which protects and secures the electric motor, and a support chamber which provides a frame for the gear assembly and an alignment groove for the live axle.

15. The apparatus, as claimed in claim 10, wherein the electric power control switch has a wire from the electric motor and a flat spring contact wire whose position is adjusted with a cam arm, where the switch is closed and circuit is complete when the cam arm pushes the flat spring contact wire against the negative electrical two-sided contact of the compartment, and the switch is open when the cam arm does not force the flat spring contact wire to touch the negative electrical two-sided contact.

16. The apparatus, as claimed in claim 1, wherein the water proof battery container comprises a twist off cap with a seal and a cylinder having a bottom with a spring and a mouth, where the cap has an electrical contact that extends through the cap, and the spring has an electrical contact that extends through the bottom, and wherein when the waterproof battery container is in the compartment, it is electrical communication with the compartments contacts.

17. A self-propelled aquatic apparatus, said apparatus comprising:

a duck shaped body, wherein said body is partially filled with floatation material, wherein said body comprises an upper body and a lower body that are joined by a sealing ring with aligning tapped studs, and wherein the lower body has an external form that provides relatively low hydrodynamic resistance;

a base;

a waterproof battery container;

a battery;

an electro-mechanical propulsion mechanism, wherein said mechanism comprises a pair of webbed feet, which alternately articulate from a forward down position to a rearward raised position; and an electric power control switch that is in selectable control of the electrical conduction between the waterproof battery container and the electro-mechanical propulsion mechanism.

* * * * *